US009255772B2

(12) United States Patent
Carton et al.

(10) Patent No.: US 9,255,772 B2
(45) Date of Patent: Feb. 9, 2016

(54) PROTECTIVE ARMOUR ELEMENT

(71) Applicant: Nederlandse Organisatie voor toegepast-natuurwetenschappelijk onderzoek TNO, Delft (NL)

(72) Inventors: Erik Peter Carton, Delft (NL); Johannes Pieter Frans Broos, Delft (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 20 days.

(21) Appl. No.: 14/338,603

(22) Filed: Jul. 23, 2014

(65) Prior Publication Data

US 2016/0010954 A1 Jan. 14, 2016

Related U.S. Application Data

(62) Division of application No. 14/110,452, filed as application No. PCT/NL2012/050256 on Apr. 19, 2012, now abandoned.

(30) Foreign Application Priority Data

Apr. 20, 2011 (EP) ..... 11163240

(51) Int. Cl.
*F41H 5/04* (2006.01)
*F41H 1/02* (2006.01)

(52) U.S. Cl.
CPC ... *F41H 1/02* (2013.01); *F41H 5/04* (2013.01)

(58) Field of Classification Search
CPC ..... F41H 5/02; F41H 5/04; F41H 5/0428; F41H 5/0435
USPC ..... 89/36.05, 36.02
See application file for complete search history.

(56) References Cited

U.S. PATENT DOCUMENTS

| | | | | |
|---|---|---|---|---|
| 3,398,406 | A | 8/1968 | Waterbury | |
| 5,601,895 | A * | 2/1997 | Cunningham | A41D 31/0061 128/878 |
| 7,150,217 | B2 * | 12/2006 | Kershaw | A41D 13/05 2/2.5 |
| 8,601,930 | B2 * | 12/2013 | Roberson | F41H 5/0428 2/2.5 |
| 2005/0019524 | A1 * | 1/2005 | Kershaw | A41D 13/05 428/116 |
| 2008/0104735 | A1 * | 5/2008 | Howland | F41H 1/02 2/2.5 |
| 2009/0229453 | A1 * | 9/2009 | Dickson | F41H 5/0414 89/36.02 |

FOREIGN PATENT DOCUMENTS

| | | | |
|---|---|---|---|
| EP | 2 180 286 | A1 | 4/2010 |
| WO | 2011/005274 | A1 | 1/2011 |

OTHER PUBLICATIONS

PCT, International Search Report, PCT/NL2012/050256 (mailed Jun. 11, 2012), 2 pages.

* cited by examiner

*Primary Examiner* — Reginald Tillman, Jr.
(74) *Attorney, Agent, or Firm* — Thompson Hine LLP

(57) ABSTRACT

The invention is directed to a protective armor element, to body armor comprising one or more of such elements, and to a preventive method of reducing behind armor blunt trauma of an individual.
The protective armor element of the invention comprises a fabric and/or a fiber based composite, wherein said armor element, prior to impact of a projectile, has a concave strike face.

21 Claims, 3 Drawing Sheets

PROTECTIVE ARMOUR ELEMENT

This application is a division of co-pending U.S. application Ser. No. 14/110,452 filed Oct. 29, 2013, which is a National Phase of International Application Serial No. PCT/NL2012/050256 filed Apr. 19, 2012, which claims priority to European Application Serial No. 11163240.2, filed Apr. 20, 2011, each of which is expressly incorporated by reference herein in its entirety.

The invention is directed to a protective armour element, to body armour comprising one or more of such elements, and to a method of preventing or reducing behind armour blunt trauma of an individual. More in particular, the invention relates to a protective armour element suitable for use in armour that is intended to withstand and provide protection against blunt trauma or ballistic impact from a projectile or the like.

In law enforcement and military environments it is often necessary and appropriate to use protective shields of various forms and configurations to protect personnel and equipment from injury or mechanical damage caused by projectiles including bullets, spall, shrapnel, etc. The protective shield may be of a type that is worn as protective personnel body armour. For such applications it is desirable that the protective shield is strong, light, and thin, and capable of dispersing or otherwise dealing with body heat and perspiration.

Body armour comprising metal and ceramic inserts is well-known. Nevertheless, in order to provide sufficient protection against the incoming energy of large fragments or high velocity bullets the inserts are relatively heavy and uncomfortable. Because of the weight, such body armour may be discarded and the respective person is left unprotected. Yet another disadvantage of this body armour is the fact that the metal and ceramic inserts merely deflect the projectile. It is not unusual for a wearer to survive the initial impact only to receive substantial and even life threatening injury as the deflected material strikes another part of his body.

In an attempt to provide light-weight alternatives, fibre-based body armour has been developed. Such body armour typically comprises polymer fabric and/or polymer fibre-based composites. In particular flexible aramid (aromatic amide) fibres have proven to be effective, for instance in bullet-proof vests for police forces and private security guards.

In contrast to the body armour comprising metal and ceramic inserts, fibre-based body armour does not protect the wearer by deflecting projectiles. Instead, the layers of high tensile strength material forming the body armour are intended to catch the projectile and spread its force over a larger portion of the wearer's body, and bring the projectile to a stop before it can penetrate into the body. This tends to deform soft-core projectile, further reducing its ability to penetrate. However, while body armour can prevent invasive bullet wounds, the wearer's body at least will follow the back-face deflection on the armour, and can often incur blunt force trauma.

In order to provide extra protection to vital areas, hard plate inserts of polymer-fibre based composites can be prepared. Such plate carrying body armour provides additional protection.

In the last few decades, several new fibres and construction methods for body armour have been developed including woven Dyneema™ (an ultrahigh molecular weight polyethylene fibre obtainable from DSM), GoldFlex™ (a roll product consisting of four plies of unidirectional aramid fiber, crossplied at 0°/90°/0°/90°, and sandwiched in a thermoplastic film obtainable from Honeywell), Spectra™ (an ultrahigh molecular weight polyethylene fibre obtainable from Honeywell), Twaron™ (a poly(p-phenylene terephthalamide) fibre obtainable from Teijin Aramid), Zylon™ (a poly(p-phenylene-2,6-benzobisoxazole) fibre obtainable from Toyobo), Kevlar™ (a poly(p-phenylene terephthalamide) fibre obtainable from DuPont, and Nomex™ (a poly(m-phenylene terephthalamide) fibre obtainable from DuPont). Although Kevlar™ has long been used, some of the newer materials are said to be lighter, thinner and more resistant than Kevlar™, but are considerably more expensive. But even so, the expense is justified because the more lightweight, thin and less insulating a protective ballistic resistant garment is made, the more likely an intended user (such as military personnel) will actually wear the garment, especially in the case of hostile environmental conditions and long working shifts.

There is a continuing need to provide improved armour materials that are thin and lightweight, have the ability to capture rather than reflect projectiles, bullet spall and the like, and in the case of body armour reduce blunt trauma injuries.

When a projectile strikes fibre-based body armour, the impact load causes a bulge to develop which deforms the back surface of the armour. Since the armour is worn adjacent to the body, this bulge or "deformation" can extend into the body of the wearer. If the deformation or deformation rate is large, tissue damage or trauma may occur. It is widely accepted that trauma resulting from back face signature (BFS) can be severe and debilitating. Hence, while the body armour stops penetration of the projectile, it allows its impulse to be transferred through the armour system directly to the body of the wearer as to cause injuries to the bone structure and internal organs. Possible medical consequences include extravasations of blood, termination of respiration, lung damage, reduced oxygen pressure in the blood (possibly leading to coma or even death). This injury is typically described as "blunt trauma", which is correlated to the extent of inward deformation suffered by the armour as it is impacted by a projectile.

WO-A-2011/005 274 discloses armour having a strike face that is outwardly convex or concave or exhibits both concave and convex surface portions. The strike face sheet preferably comprises titanium, a titanium alloy, aluminium, an aluminium alloy; an organic-matrix composite material, such as, for example, graphite-carbon- or fibreglass-reinforced epoxy composite material, a laminated material, such as titanium/aluminium laminate. The document does not disclose a protective armour element comprising a fabric and/or a fibre based composite in combination with a concave strike face. EP-A-2 180 286 discloses a ballistic collar which is arranged to surround a human's neck, comprising a harmonica shaped member. The member is preferably formed by a plurality of plied sheets, preferably made of a ballistic rated body armour fabric comprising strong synthetic fibres. The strike surface is not concave and not inwardly curved.

U.S. Pat. No. 3,398,406 discloses a body armour comprising horizontally extending ribs. The ribs are horizontally and vertically convex and the strike face is composed of a plurality of double convex elements.

Objective of the invention is to overcome at least part of the disadvantages of the prior art by providing a fibre-based protective armour element that exhibits reduced deformation upon impact of a projectile.

Further objective of the invention is to provide a fibre-based body armour that reduces the wearer's risk of suffering from behind armour blunt trauma.

The inventors surprisingly found that the deformation of fibre-based protective elements is less when the strike face of the element has a specific form.

Accordingly, in a first aspect, the invention is directed to a protective armour element comprising a fabric and/or a fibre based composite, wherein said armour element, prior to impact of a projectile, has a concave strike face.

The inventors surprisingly found that the protective armour element of the invention has significantly less deformation upon impact of a projectile. Due to the use of fabric, the protective armour of the invention is advantageously light weight. Accordingly, body armour comprising protective armour elements as defined herein have a reduced risk of giving rise to behind armour blunt trauma.

Especially for body armour, it is conventional to provide armour having a convex strike face, so that the armour can locally follow the curvature of the human body as much as possible. For metal or ceramics materials this is not very relevant because these materials do not strongly deform in the direction of the body. The inventors realised that this is different for protective armour elements on the basis of fabric and/or fibre based composite. Since these fibre materials result in a much larger deformation in the direction of the body upon impact of the projectile, the shape of the protective armour element is much more relevant. Surprisingly, the inventors found that even though such armour elements conventionally have a convex strike face in view of the object or individual to be protected, the actual deformation upon impact is much smaller when the armour element has a concave strike face.

Without wishing to be bound by theory, the inventors believe that armour based on fabric and/or fibre based composite is only effective if the fibres are subject to an axial tensile stress. Due to the concave (or even flat) starting shape of the protective armour elements a large deformation is required in order to provide the fibres with sufficient tensile stress. This is because the convex shape should first locally be turned over to a concave shape, during which the fibres are not subject to more tensile stress than in the starting situation. On the other hand, impact of a projectile on a protective armour element having a concave strike face immediately leads to a significant increase in tensile stress of the fibres and, as a result, to a smaller deformation of the protective armour element.

The term "armour" as used in this application is meant to refer to materials that are resistant to forces applied to the armour to penetrate the armour such as projectiles and the like.

The term "concave" as used in this application is meant to refer to a surface that is curving inward as opposed to convex. It is understood that the concave is not restricted to describing a surface with a constant radius of curvature, but rather is used to denote the general appearance of the surface. In addition, it is understood that multiple concave elements can still form an overall convex surface as will be explained herein below.

The concave strike face of the armour element can have a radius of curvature that is greater than the thickness of the armour, such as 20% greater than the thickness of the armour, 50% greater, 100% greater, 200%, 300%, 400%, 500%, 1000%, 2000%, or even greater. The radius of curvature of the strike face of the armour element must be smaller than infinity, otherwise the strike face is not concave.

Preferably, the size of the armour element can vary widely. It is preferred that the size of the armour element is larger than the projectile against which the armour is supposed to provide protection. Hence, the armour element can have an equivalent circular diameter (defined as the diameter of a circle that has the same area as the armour element) ranging from 1-100 cm, preferably 1-50 cm, such as 2-40 cm, 2-25 cm, or 3-10 cm.

In a preferred embodiment, the protective armour element comprises a reinforced fibre material. The reinforced fibre material can comprise a multi-layer of weaves and a composite thereof with a matrix. Suitably, the reinforced fibre material can comprise polymer fibres, but also carbon fibres, glass fibres, and the like may be employed. It is however, preferred, that the reinforced fibre material comprises a polymer fibre. The fibres in the reinforced fibre material may be embedded in a polymer matrix, such as an epoxy, vinyl ester or polyester thermosetting plastic.

Suitably, the protective armour element comprises one or more from the group consisting of ultrahigh molecular weight polyethylenes, polyamides (including aromatic polyamides such as poly(paraphenylene terephthalamide), poly (metaphenylene isophthalamide and poly(metaphenylene terephthalamide)), poly(p-phenylene-2,6-benzobisoxazole). Examples of these materials are commercially available under the trademarks Dyneema™, GoldFlex™, Spectra™, Twaron™, Zylon™, Kevlar™, Nomex™, and the like.

The protective armour element comprises a fabric and/or a fibre-based composite. In an embodiment, the protective armour element consists of fabric and/or fibre-based composite. Preferably, the fabric is a polymer fabric and/or the fibre-based composite is a polymer fibre-based composite. Polymer fabric protective armour elements can provide protection against shrapnel and so-called soft-core ammunition (typically ammunition fired from rifles). A polymer fibre-based composite can provide additional protection, such as against armour piercing bullets using a hard metal or ceramic strike-face.

Therefore, in a further aspect the invention is directed to an armour system, comprising a ceramic or metal strike face and one or more protective armour elements according to the invention as a backing for said ceramic or metal strike face.

The present invention is especially advantageous when applied in body armour. Accordingly, in a further aspect the invention is directed to body armour comprising one or more protective armour element as defined herein.

The body armour of the invention can comprise at the body face of the armour and opposite the concave strike face, an anti-trauma liner. Such liners are well-known in the art. Typically, such anti-trauma liners comprise foam material. Anti-trauma liners help to reduce the indent of the human body by facilitating the first phase of back-face deformation of the armour were the acceleration and maximal velocity are highest. The human body only experiences the latest phase of the deflection at which both the acceleration and maximal velocity are considerably reduced.

Suitably, the body armour of the invention can be in the form of a helmet, an insert for a vest, and side-protection plate.

The protective armour element comprises a fabric and/or a fibre based composite. The fabric comprises fibre and/or is fibre based, preferably glass, carbon and/or polymer fibre. The fibre based composite is preferably based on glass, carbon and/or polymer fibre. A fabric and/or a fabric based composite comprising polymer fibres is preferred.

The fibres are preferably applied in such a way that an inward distortion of the armour element results in axial tensile stress of the fibres. Suitably, the fibres are woven. Suitably, the fibres are applied in a direction along the inward curve of the armour element strike face. In this way, the fibres extend at least in part in the inward direction. The fibres are preferably applied in a direction in which the strike face is concave.

The body armour preferably comprises a plurality of armour elements. The armour elements are preferably arranged in such a way, that the concave strike area of the armour elements of the body armour is 50% or more, more preferably 75% or more, up to 99% or more, up to close to, but smaller than, 100% of the total strike face area of the body armour.

The body armour preferably comprises a plurality of concave armour elements, such as 5 or more, preferably 10 or more, more preferably 20 or more armour elements (such as 20-50 armour elements), while the overall strike face of the armour is convex. For example, such armour could have an arrangement of armour elements as in a golf ball. A golf ball has the overall convex shape of a sphere, while the dimples are concave.

BRIEF DESCRIPTION OF THE DRAWINGS

FIG. 2A, and a cross-section of a helmet without FIG. 2B, and with FIG. 2C, an anti-trauma liner.

The armour elements comprise a recess in the strike face of the armour. The recess has a shape in the plane of the strike face when viewed from the top that can be a circle, as for example in FIG. 2A, or a square, rectangle, triangle, hexagon, or another shape. An armour may comprise armour elements with various shapes and sizes. When the armour elements have recesses with circular shape, as in FIG. 2A, some gaps present between the armour elements as circles are not tessellating. Preferably, the armour elements are arranged in pattern wherein the space between the armour elements is minimal, such as in a tessellating pattern. For circles and hexagons, a hexagonal lattice arrangement or honeycomb pattern is preferred.

Figure 2A:
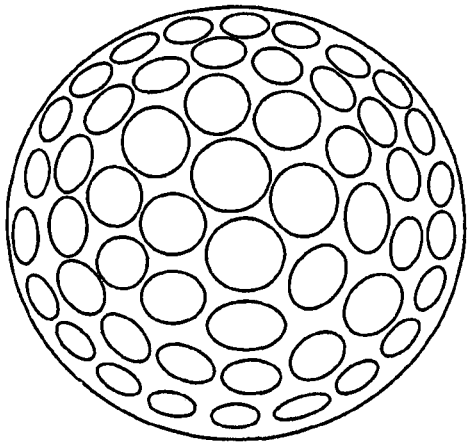
FIGS. 2A-C show examples of a helmet with multiple concave protective armour elements.
Figure 2B:
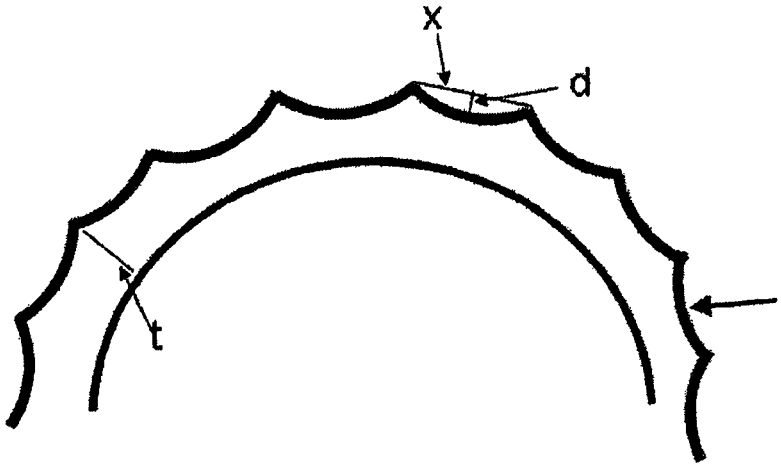

The recess in the strike face has a depth d, measured as the maximum depth of the recess relative to a tangent line x over the strike face, as shown in FIG. 2B. The depth d may be smaller, equal or larger than the equivalent circular diameter (A). Preferably, the depth is 0.1 A-1 A, more preferably 0.20-0.80 A, even more preferably 0.3-0.7 A.

Figure 3:
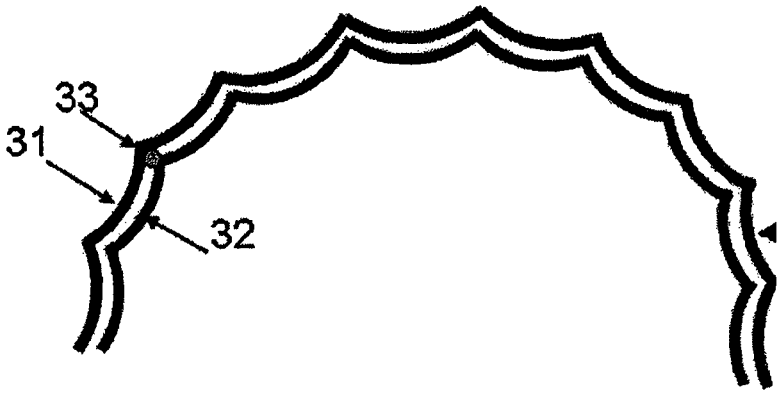
FIG. 3 shows an example of an armour with an inner surface that follows the strike face.

The armour has an average thickness t, excluding the recesses of the armour element (t in FIG. 2B). The recess of an armour element has preferably a depth d of 0.05-0.95 t, more preferably 0.05-0.5 t, even more preferably 0.05-0.25 t. The depth d of the recess may even be larger than the thickness, if the inner surface of the armour follows the strike face. An inner surface that is essentially conformal to the strike face follows the strike face. In FIG. 3, an example is shown of a armour with an inner surface 32 that follows strike face 31. In case the armour has an inner surface that follows the strike face, or is essentially conformal to the strike face, the thickness t is preferably 0.1-2 d, more preferably 0.5-1.5 d, even more preferably 0.75-1.5 d, most preferably 0.9-1.3 d.

The inside face of a body armour is preferably conformal to the body, the inside face of a helmet is preferably conformal to a head. The armour elements may be comprised in a helmet and the body armour may be a helmet.

Suitably, the armour element is reinforced, at least in part, at the strike face parts not comprised in an armour element with concave strike face and or close to the outward end of the armour elements. For example, in FIG. 3 the armour is reinforced at position 33.

Figure 1A:
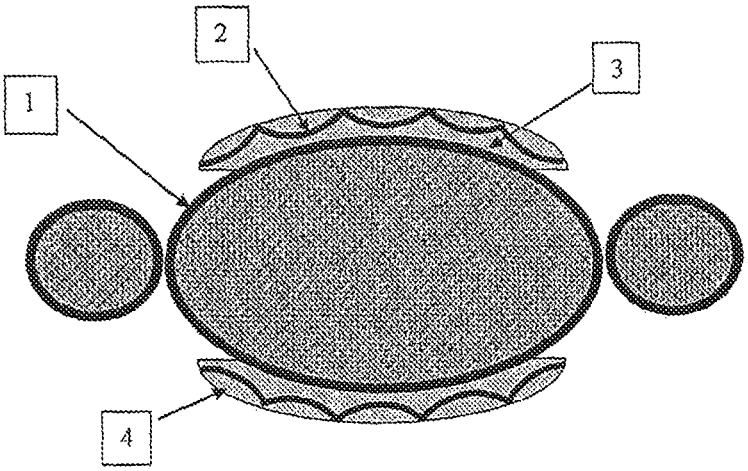
FIGS. 1A-B show examples of a front insert plate and a back insert plate.
Figure 1B:
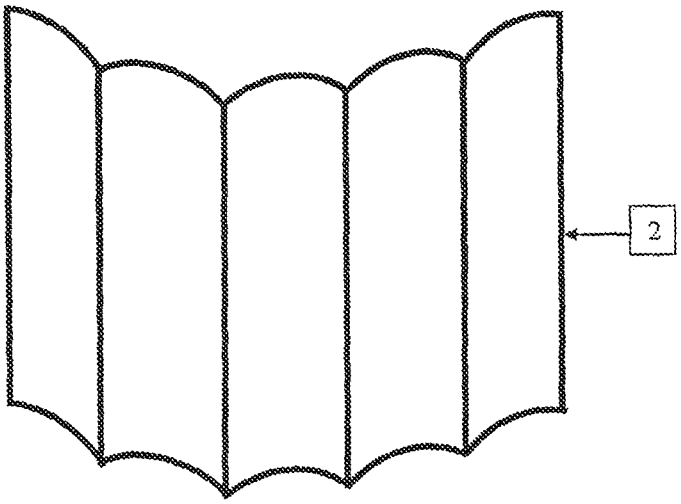

Examples of a front insert plate and a back insert plate in accordance to the invention are shown in FIG. 1. FIG. 1A is a cross-section of a vest (1), with a front insert plate and back insert plate (4). The insert plate comprises multiple concave protective armour elements (2). The insert plate further comprises an anti-trauma liner foam (3). Back insert plate (4) is similar in design as front insert plate (2). FIG. 1B is a front view of the insert plate just showing the multiple concave protective armour elements (2).

Figure 2C:
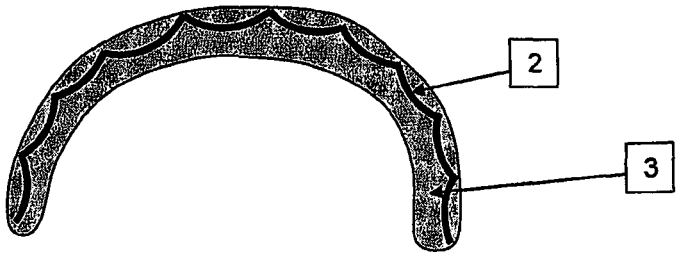

An example of a helmet in accordance with the invention is shown in FIG. 2. FIG. 2A is a top view of the helmet showing the multiple concave protective armour elements (2). FIG. 2B shows a cross-section of a helmet that does not have an anti-trauma liner, while the helmet of FIG. 2C comprises, apart from the multiple concave protective armour elements, an anti-trauma liner (3). The helmet shown in FIG. 2 has an overall convex strike face that is built up from multiple protective armour elements having a concave shape.

The invention will now be further elucidated by the following Examples, which are not intended to limit the invention in any way.

EXAMPLES

Experiments were performed to test the difference in clay indent of an armour element upon impact of a projectile when the armour element has a concave striking face or a convex striking face.

Example 1

Helmet

In this example, 9 mm FMJ bullets were shot at a speed of about 400 m/s on 7 mm thick Dyneema™ helmets. The non-striking face of the helmet was either in contact with clay or a small air gap was maintained between the helmet and the clay. After impact the level of indent was determined by measuring the depth of the crater in the clay. The shots were either fired with the convex side of the helmet as striking face, or with the concave side of the helmet as striking face. The results are shown in Table 1.

TABLE 1

| Striking face | Air gap [mm] | Bullet speed [m/s] | Clay crater depth [mm] |
|---|---|---|---|
| convex | 0 | 426 | 35 |
| concave | 0 | 358 | 16 |
| convex | 18 | 424 | 26 |
| concave | 18 | 420 | 0 |

Example 2

Body Insert-Plate

In this example, 7.62×51 Ball ammunition was shot at a speed of about 840 m/s on 20 mm thick Dyneema™ body inserts. The non-striking face of the body insert was either in contact with clay or a small air gap was maintained between the body insert and the clay. After impact the level of indent was determined by measuring the depth of the crater in the clay. The shots were either fired with the convex side of the body insert as striking face, or with the concave side of the body insert as striking face. The results are shown in Table 2.

TABLE 2

| Striking face | Air gap [mm] | Bullet speed [m/s] | Clay crater depth [mm] |
|---|---|---|---|
| convex | 0 | 826 | 64 |
| concave | 0 | 836 | 44 |
| convex | 17 | 846 | 45 |
| concave | 17 | 850 | 30 |

The invention claimed is:

1. A body armour element comprising a strike layer comprising concave outer surfaces and convex inner surfaces opposite the concave outer surfaces; and a support layer comprising reinforcing fibers embedded in a flexible polymer matrix that adjoins the convex inner surfaces of the strike layer, at least some fibers being arranged in such a way that inward distortion of the convex inner surfaces of the support layer results in tensile stress to the fibers, whereby inward distortion of the strike layer under an impact at a concave outer surface is resisted by tensile strength of the fibers.

2. The body armour element of claim 1 where the strike layer comprises a ceramic.

3. The body armour element of claim 1 where the strike layer comprises a metal.

4. The body armour element of claim 1 where the strike layer comprises a ceramic and a metal.

5. The body armour element of claim 1 where the strike layer and the support layer have an average combined thickness, and the strike layer concave outer surfaces have arcuate contour with radii of curvature greater than the average combined thickness.

6. The body armour element of claim 1 where the strike layer is a unitary layer.

7. The body armour element of claim 1 where the strike layer further has convex outer surfaces in gaps between concave outer surfaces.

8. The body armour element of claim 7 where the convex outer surfaces are in a tessellating pattern.

9. The body armour element of claim 1 where the concave outer surfaces are on an outer side of the strike layer having an overall convex contour.

10. The body armour element of claim 1 where the support layer has an inner side with an overall concave contour.

11. The body armour element of claim 1 where the strike layer and the support layer comprise a vest insert plate and the support layer has an inner side with an overall concave contour conforming to a torso.

12. The body armour element of claim 1 where the strike layer and the support layer comprise a helmet and the support layer has an inner side with an overall concave contour conforming to a head.

13. A body armour element comprising a strike layer comprising a unitary material having concave outer surfaces with gaps therebetween, convex outer surfaces in the gaps between the concave outer surfaces, and convex inner surfaces opposite the concave outer surfaces, and a support layer comprising reinforcing fibres embedded in a flexible polymer matrix that adjoins the convex inner surfaces of the strike layer, at least some fibres being arranged in such a way that inward distortion of the convex inner surfaces of the support layer results in tensile stress to the fibres, whereby inward distortion of the strike layer under an impact at a concave outer surface is resisted by tensile strength of the fibres.

14. The body armour element of claim 13 where the unitary material comprises a ceramic.

15. The body armour element of claim 13 where the unitary material comprises a metal.

16. The body armour element of claim 13 where the unitary material comprises a ceramic and a metal.

17. The body armour element of claim 13 where the strike layer and the support layer have an average combined thickness, and the concave outer surfaces have arcuate contours with radii of curvature greater than the average combined thickness.

18. The body armour element of claim 13 where the concave and convex outer surfaces are on an outer side of the strike layer having an overall convex contour.

19. The body armour element of claim 18 where the support layer has an inner side with an overall concave contour.

20. The body armour element of claim 19 where the strike layer and the support layer comprise a vest insert plate and the overall concave contour at the inner side of the support layer conforms to a torso.

21. The body armour element of claim 19 where the strike layer and the support layer comprise a helmet and the overall concave contour at the inner side of the support layer conforms to a head.

* * * * *

UNITED STATES PATENT AND TRADEMARK OFFICE

CERTIFICATE OF CORRECTION

PATENT NO. : 9,255,772 B2
APPLICATION NO. : 14/338603
DATED : February 9, 2016
INVENTOR(S) : Erik Peter Carton and Johannes Pieter Frans Broos It is certified that error appears in the above-identified patent and that said Letters Patent is hereby corrected as shown below:

Title Page, Item (73) Assignee

"Nederlandse Organisatie Voor Toegepast-Natuurwetenschappelijk Onderzoek TNO" should read -- Nederlandse Organisatie voor toegepast-natuurwetenschappelijk onderzoek TNO --

Signed and Sealed this
Sixteenth Day of August, 2016

Michelle K. Lee

Michelle K. Lee
*Director of the United States Patent and Trademark Office*